United States Patent [19]

Hague et al.

[11] 4,131,164

[45] Dec. 26, 1978

[54] ADAPTIVE VALVE CONTROL SYSTEM FOR AN IMPACT DEVICE

[75] Inventors: Wilmer W. Hague, Fayetteville; Charles W. Frame, Chambersburg, both of Pa.

[73] Assignee: Chambersburg Engineering Company, Chambersburg, Pa.

[21] Appl. No.: 854,022

[22] Filed: Nov. 23, 1977

[51] Int. Cl.[2] ..... F15B 21/02

[52] U.S. Cl. ..... 173/1; 173/2; 173/115; 91/40; 91/275

[58] Field of Search ..... 73/12, 82; 91/39, 40, 91/219, 248, 275; 173/1, 2, 115

[56] References Cited

U.S. PATENT DOCUMENTS

| | | | |
|---|---|---|---|
| 2,691,962 | 10/1954 | Johnson | 91/39 X |
| 2,931,388 | 4/1960 | Renick et al. | 91/39 X |
| 3,464,315 | 9/1969 | Weyer | 91/165 |
| 3,818,799 | 6/1974 | Hague | 91/40 |

FOREIGN PATENT DOCUMENTS

| | | | |
|---|---|---|---|
| 615571 | 2/1961 | Canada | 91/275 |
| 390232 | 10/1973 | U.S.S.R. | 73/82 |

*Primary Examiner*—Lawrence J. Staab

*Attorney, Agent, or Firm*—Dann, Dorfman, Herrell and Skillman

[57] ABSTRACT

Switch means on the frame of a forging device senses when the ram and piston enter a first zone of a pneumatic cushion during retraction to initiate timing. If a predetermined time has expired before the ram leaves the first zone, the fluid inlet valve is opened. If not, switch means senses when the ram and piston enter a second zone to initiate a second timing. If a second predetermined time expires before the ram leaves the second zone, the fluid inlet valve is opened. If not, switch means senses when the ram and piston enter a third zone, and after a predetermined time the fluid inlet valve is opened. Thus, by sensing ram position and measuring time ram remains within each zone, the effective upward velocity (distance/time) is measured and adaptive controls applied.

10 Claims, 6 Drawing Figures

CYLINDER CUSHION ARRANGEMENT

LOW VELOCITY

MEDIUM VELOCITY

HIGH VELOCITY

ADAPTIVE VALVE CONTROL SYSTEM FOR AN IMPACT DEVICE

The present invention relates to an improvement in a stroke control system for an impact device, such as a forging hammer. The present invention also relates to an improved method of controlling such an impact device. More specifically, the present invention relates to an improved system and method which causes the valve in the fluid feedline to drive the impact device to open just as the port into the cylinder becomes fully uncovered as the piston moves with its associated ram in the direction of impact.

BACKGROUND OF THE INVENTION

The present invention relates to an improvement in a storke control system for an impact device which impact device is driven by a compressible fluid and is capable of performing a series of blows. Such an impact device, or hammer, is described in U.S. Pat. No. 3,464,315 to which reference is made. U.S. Pat. No. 3,818,799 discloses a control system whereby the number and intensity of a series of blows to be performed by such a hammer may be pre-programmed thus permitting essentially automatic operation. This control system utilizes a switch which is adjustably positionable on the frame member and actuated by the moving hammer to sense the position of the ram and thereby properly coordinate the operation of the main driving fluid valve. The length of time said valve remains open together with the supply pressure determines the intensity of the impact of successive blows. The velocity of the ram varies depending upon the characteristics of the forging blow. Therefore, timing the opening of the main driving fluid valve to drive the ram the same way on each successive stroke has produced variable force results at the next impact. Thus, in the prior art, despite the use of sophisticated programming controls, successive blows have been variable and of unpredictable intensity.

We have determined that the causes of this variability has been either the variation in the amount the fluid supply port has been opened, or the variation in the degree of piston stroke before the supply valve is opened. To the extent that the port has been partially closed by the piston when the fluid supply valve has been opened, there has been a decrease in the effective force of the hammer blow. To the extent the piston stroke is greater when the supply valve is opened, there has been a decrease in the effective force of the blow.

The present invention provides a means to assure that the port is not partially blocked by the piston and the piston stroke is consistent where the supply valve is opened. Therefore, the intensity of a blow cannot be modified by a partially occluded port or variable piston storke. In particular, the timing of the opening of the main driving fluid valve is such that the piston is properly oriented to assure the port is just completely open on each successive blow.

SUMMARY OF THE INVENTION

More specifically, the present invention concerns an improvement for a stroke control system for an inpact device. The impact device is of the general type which has a frame supporting at least one cylinder, a piston within said cylinder and means connecting said piston to a ram such that the ram is repeatedly movable relative to the frame from a retracted position to an impact position. A drive fluid system is provided for the cylinder including a fluid supply and valve means connecting said fluid supply to a port into said at least one cylinder. The port is located at a position in the cylinder to cause the fluid to drive said ram into said impact position.

Operating means for controlling the valve means is under the control of the improved device. The improved device includes signal generating means producing a distinctive signal when the ram, in its return stroke, reaches each of a plurality of preselected positions, each defining a position of a time zone. Timing means is connected to and responds to the signal generating means to initiate time counting measuring the duration of each distinctive signal that is produced while the ram remains in its specific zone and terminates counting when the ram enters another zone. Logic means is connected to, and responds to, the timing means and signal generating means to actuate the operating means if predetermined times in each zone are reached. The logic means discontinues timing when the signal generating means indicates entry into another zone.

The method of the present invention involves sensing when the piston and the ram structure enters successive zones near the end of the ram return stroke. Timing is begun and continued while the ram remains in the first zone to a predetermined count which assures complete uncovering of the port. The valve means is opened if the predetermined count is reached before the next zone is reached. Similar counting may be initiated to time the period the ram remains in each successive zone until the last zone wherein timing is not dependent upon the period the ram remains in the zone.

BRIEF DESCRIPTION OF THE DRAWING

For a better understanding of the invention, reference is made to the accompanying drawings in which, FIG. 1 schematically shows a fluid control system.

DESCRIPTION OF THE INVENTION

Figure 1:
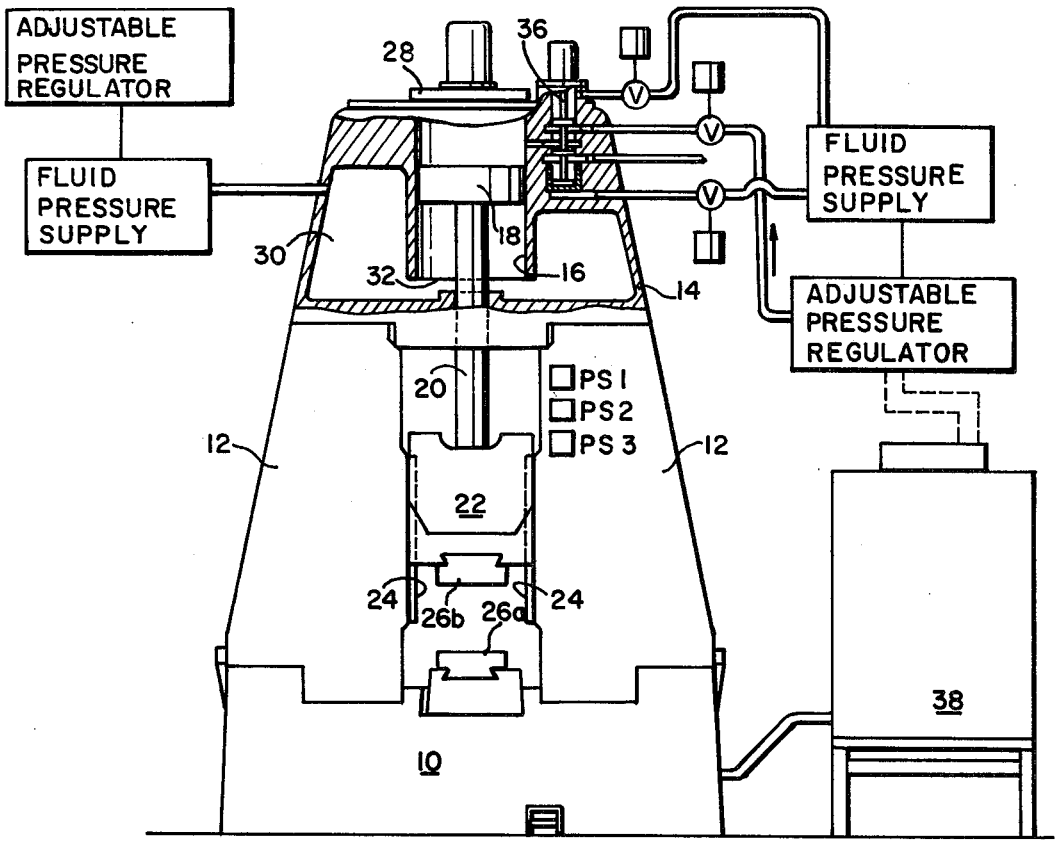

Referring to FIG. 1 an impact or forging device operating in a vertical orientation is shown with its ram in its top of stroke position. The invention herein described is likewise applicable to forging devices which operate in a horizontal orientation, including particularly those employing two opposed rams. Such a device is described, for example, in U.S. Pat. No. 3,916,499. All impact devices employing driving fluid to drive a piston where the method and system herein disclosed and within the scope of the claims are intended to be included within the scope of the present invention.

Referring to FIG. 1, there is shown a pneumatic impact device which, in its perferred form constitutes a high speed sequence program controlled die forger with suitable controls. The device depicted is highly schematic in that the hammer itself is to a large degree of the same general construction as that hammer shown in U.S. Pat. No. 3,464,315, to which reference may be had for further details of construction. FIG. 1 depicts the preferred embodiment of the present invention schematically with its ram and thereby the piston in the cylinder in its normal top of stroke position.

The device shown is a high speed forging hammer for flat die work and impression die work controlled by an electrical sequence program controlled system as opposed to the mechanical pneumatic servo control system of the aforesaid patent, which accounts for a number of differences in the control feature.

Like the earlier device the major parts of the hammer are the anvil 10, a pair of upright frame members 12 and a yoke 14. These parts are bolted together in conventional fashion for a machine of this type to accommodate heavy impact vibration forces. The anvil and frame members are generally standard cast construction but the yoke is modifiedand of the general type taught by Pat. No. 3,464,315. The yoke 14 is provided with various cavities, the largest of which is centrally located cylinder 16, which is of generally right circular cylindrical form with a vertically oriented axis. In this cylinder is located a piston 18, which is moved up and down within the cylinder by introduction of air pressure. Air is introduced and removed from the cylinder through ports in its walls. The piston 18 is connected by piston rod 20 to a ram 22. The piston rod passes through a suitably gasketed bushing to prevent leakage of air from the cylinder along the piston rod.

The ram is always in contact or close proximity with the guided by guide pieces 24 which are bolted onto the frame members 12, four of which guide pieces are preferably used in order to assume the same ram positioning at impact, blow after blow. The anvil 10 and the ram 22, respectively, carry forging dies **16*a* and 26*b* between which is fed metal stock to be forged in conventional manner. The piston 18 is provided with suitable piston rings which effectively prevent flow around the edges of the piston between it and the cylinder walls. The cylinder preferably has a replaceable cylinder liner providing a uniform cylinder wall and wear surface for cooperation with piston 18. The top of the cylinder is closed by a suitable cylinder head 28, preferably bolted to the yoke 14. A reservoir or surge tank 30 communicates with the cylinder 16 through passage 32 at the bottom of cylinder 16. Air under pressure is fed into the reservoir 30 through suitable feed means (not shown) provided with pressure regulating means which is arranged to admit air only when pressure drops below a predetermined value. When greater air pressure is applied to the impact (upper) side of piston 18 to urge the piston downward driving the ram 22 to impact, air is forced out of the bottom of the cylinder through passage 32 into reservoir 30 and in this process the total volume of air is compressed. Then when air is exhausted from the cylinder above the piston the pressure of the air in this reservoir 30 drives the piston back upwardly. Ordinarily the piston is retained in its retracted position shown in FIG. 1 solely by the pressure of air beneath the piston and in reservoir 30**. This pressure is sufficient without other mechanical restraint to hold the ram ready for use until driving air is reintroduced above the piston.

Also shown in FIG. 1 is a control console 38 which contains the electrical circuitry for operating the die forger in a preprogrammed sequence of blows.

When the device has been programmed to perform a series of blows, it is essential to smooth, consistent operation that the compressed fluid be admitted to cylinder 16 for each successive blow at such time that ram 22 is at essentially the same point in its stroke. This will assure that for each successive blow, driving fluid will be admitted to cylinder 16 with piston 18 also consistently in the same position. It has been found that the optimum time for admitting the compressed fluid is when the piston 18, in its driving stroke (downward in FIG. 1) has just uncovered main cylinder port 34. If the inlet driving fluid is admitted before piston 18 uncovers port 34, the incoming fluid will be partially blocked and the resulting blow will be of less thann the than intensity. If the incoming fluid is admitted some time after piston 18 uncovers port 34, the effective cylinder volume will be larger than anticipated and the resulting blow will again be of lesser intensity than programmed.

The present invention, therefore, provides a method for controlling the time at which the compressed fluid is admitted to the cylinder by providing sensing means for monitoring the post impact (upward in FIG. 1) position and time within successive zones of the ram 22. By this means, the post impact velocity of the piston 18 in cylinder 16 is effectively determined within limits necessary for a particular application. The sensing means contemplated by the instant invention are capable of generating signals for various lengths of time. These signals after discrimination by suitable means will ultimately control the timing of the opening of main valve 36. When the ram 22 returns to its normal top of stroke position, the piston 18, overshoots and covers port 34 to some extent. The driving fluid must not be admitted until the piston moves down to a position just below and not covering main cylinder port 34. The admission of the driving fluid to cylinder 16 through port 34 is controlled by main valve 36. Shown in FIG. 1 are sensing switches PS1, PS2, and PS3 which are mounted on the frame 12, and which are preferably solid state proximity switches. The sensing switches are shown in their preferred orientation and are mounted so that when the ram 22 is in its normal top of stroke position, PS1 is above the top edge of ram 22, preferably about 3 inches above in the standard Chambersburg hammer Model No. 8DF, PS2 is set 1½ inches above the top edge of ram 22, and PS3 is set ½ inch below the top edge of ram 22. The sensing switches are connected to timing means which is connected to logic means which controls the operation of means for opening and closing main valve 36. The logic means and timing means may conveniently be contained in the control console 38.

The depicted combination of three sensing switches and their relative positions is the preferred form of the signal generating means for utilization in the instant invention. These switches when connected to a potential source generate a signal of the potential of the source when closed and no potential when open. Using the presence or absence of potential signals the sensing means enable detection of the beginnings of these zones and the ends of the first two and, therefore, define the time when the ram remains in the zones. By timing these periods a detection of approximate level of post impact ram velocity is measured as follows:

(a) Minimum Velocity - Ram makes PS3 for approximately 200 milliseconds, after which time the inlet valve 36 is opened.

(b) Medium Velocity - Ram makes PS3 and PS2 and does not make PS1. Inlet valve 36 is opened approximately 100 milliseconds after ram makes PS2.

(c) Maximum Velocity - Ram makes PS1, which after approximately 50 milliseconds delay, the inlet valve 36 is opened.

Other position indicating means besides switches may be substituted as signal generating means.

Those skilled in the art will recognize that other arrangements for, as well as various number of, signal generating means may be utilized in the present invention. Photoelectric means, for example, may be located on frame 12 which means may be substituted for proximity switches to monitor the passage of marks on the relatively movable surfaces. A single switch or photosensor may be used to detect successive points on the relatively movable members and be associated with means to generate a particular signal after a first pulse and a different signal thereafter, etc., to distinguish successive zones.

Figure 2:
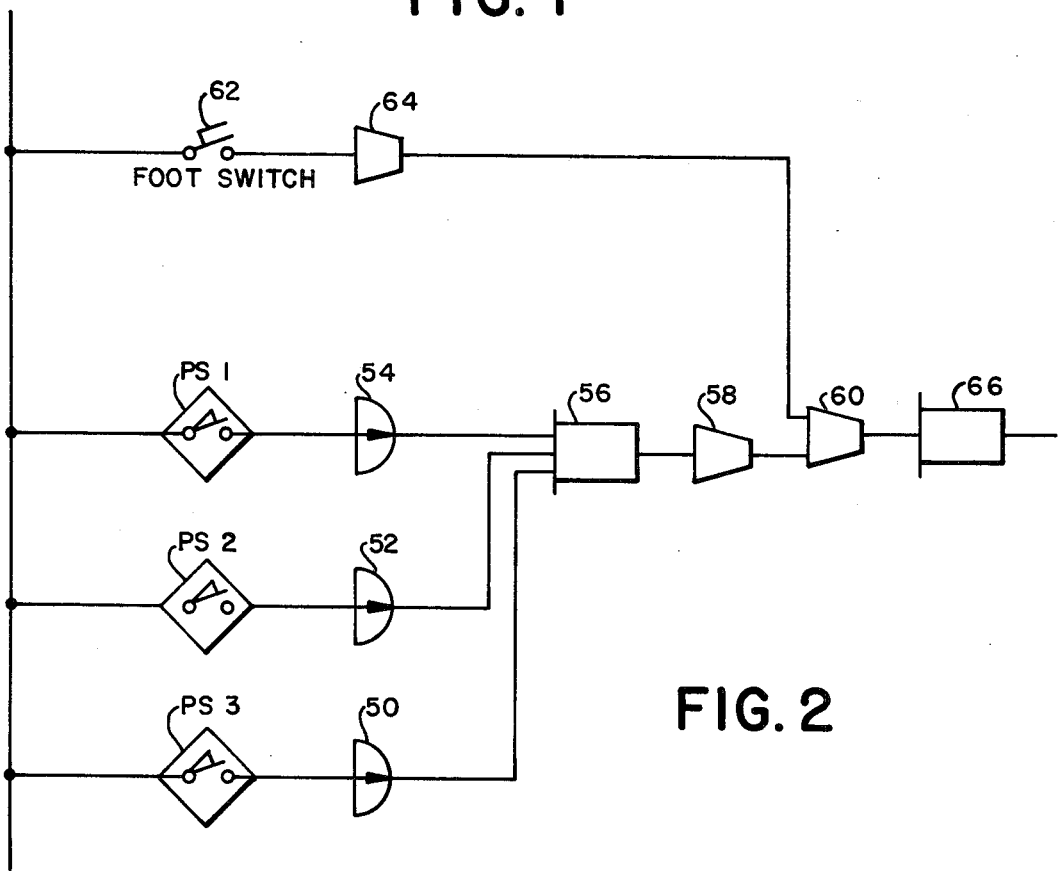
FIG. 2 is a block diagram schematically representing one improved control system in accordance with the present invention.

FIG. 2 represents schematically in a block diagram a system in accordance with the present invention wherein a series of timers, 50, 52, and 54 is triggered by signals from switches, PS3, PS2 and PS1, respectively, to start a timing functon. As will be observed, the output of switch PS3 is connected to timer 50 which, after a delay of 200 milliseconds produces an output to a single shot multivibrater 56 through pulse forming network 58 to one terminal of AND gate 60. If the foot switch 62 is closed a signal is produced at gate 64 for the other input of AND gate 60 to trigger the inlet valve solenoid timer 66.

The output of switch PS2 is connected to timer 52, which, after a delay of 100 milliseconds produces an output to single shot multivibrator 56, mentioned above. An output from multivibrator 56 reaching pulse forming gate 58 provides a signal at gate 60. Again, when combined with a signal produced by the foot switch 62 gate 60 will produce an output to trigger the inlet valve solenoid timer 66.

If the ram is moving fast enough to make switch, PS1,. a 50 millisecond delay is initiated at timer 54 from the output of PS1. The output from timer 54 then triggers multivibrator 56, as mentioned above, if foot switch 62 is closed and the inlet valve solenoid timer 66 is energized earlier to compensate for the faster motion of the ram.

Figure 3:
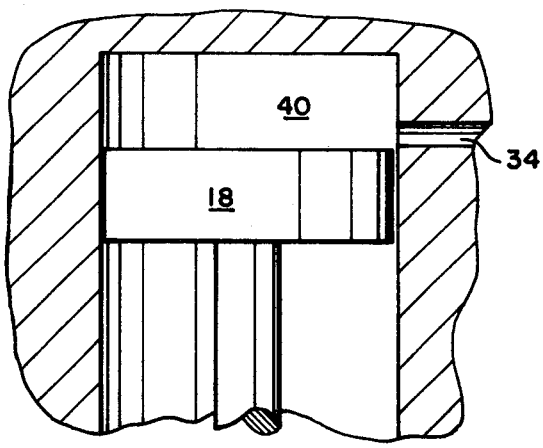
FIG. 3 is an enlarged schematic diagram of the piston and cylinder cushion arrangement.

Referring to FIG. 3, a cylinder cushion arrangement above the piston at the top of the ram stroke is shown. As the ram is lifted after an impact blow, the piston eventually covers the cylinder port and engages the pneumatic cushion in cylinder space. Depending upon the upward velocity of the ram assembly, the piston will enter the cushion space, and compress the cushion air at differing rates.

Figure 4A:
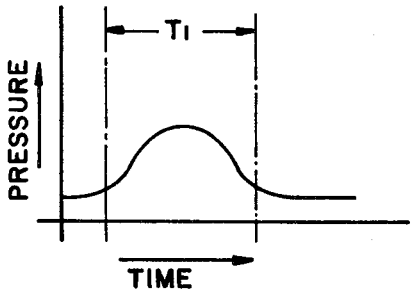
FIGS. 4A, 4B and 4C represent pressure vs. time characteristics within the cylinder cushion under conditions of low, medium and high velocity, respectively.
Figure 4B:
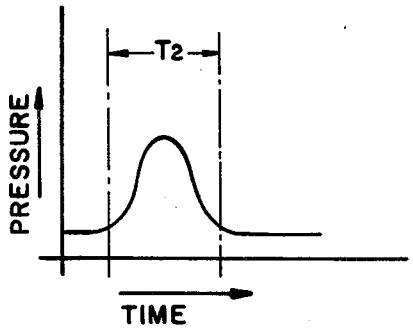
Figure 4C:
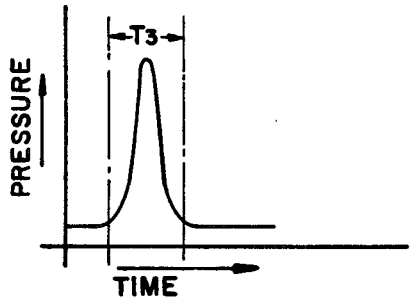

FIGS. 4A, 4B and 4C are diagrams showing pressure plotted verses time, the pressure representing cushion air pressure with cushion space 40. These diagrams show how the piston velocity affects the time of piston dwell within the cushion space, and thus, the need for a delay which is inversely proportional to ram velocity.

There is another aspect of the adaptive control system. As the piston leaves the cushion (ram moving downward) the ram assembly possesses a residual energy proportional to the square of its momentary velocity. When the inlet valve is opened additional energy is applied. In order to assure that all repetitive blows are of equal intensity, the adaptive control systems must recognize and compensate for the residual energy. Experience has proven that, by properly adjusting the delay times (T1, FIG. 4A, T2, FIG. 4B, and T3, FIG. 4C) the control system can adapt to compensate. Such adjustment may be made after observing and measuring curve parameter.

Other modifications will occur to those skilled in the art. All such modifications are intended to be within the scope and spirit of the present invention insofar as they are included within the scope of the claims pended hereto.

We claim:

1. In a stroke control system for an impact device having a frame supporting at least one cylinder, a piston within said cylinder and means connecting said piston to a ram such that said ram is repeatedly movable relative to said frame from a retracted position to impact position, a driving fluid system, including a fluid supply and valve means connecting said fluid supply to a port into said at least one cylinder at a position in the cylinder to cause the fluid to drive said ram into impact position, and operating means for controlling said valve means, an improvement whereby the valve means is opened consistently when the piston in the ram driving stroke has just uncovered said port so that each successive blow of the ram is of consistent energy, comprising:

signal generating means producing a distinctive signal when the ram, in its return stroke, reaches each of a plurality of pre-selected positions, each defining the beginning of a time zone;

timing means connected to said signal generating means and responding to the respective signals to initiate time counting, measuring time from first generation of the distinctive signals that are produced; and logic means connecting to and responding to the timing means and signal generating means to actuate said operating means if predetermined times in each zone are reached.

2. The improved stroke control system of claim 1 in which the time counting initiated by a particular signal when the ram enters a time zone is terminated by the logic means when the ram enters another zone.

3. The improved stroke control system of claim 1 in which signal generating means includes switch means operated by relative movement of the ram.

4. The improved stroke control system of claim 3 in which signal generating means includes a potential source whereby the potential is sensed at the control system if the switch means is closed, and not sensed if it is opened.

5. The improved stroke control system of claim 3 in which at least two switches are employed.

6. The improved stroke control system of claim 5 in which at least three switches are employed.

7. The improved stroke control system of claim 3 in which the switch means are solid state proximity switches.

8. The method of obtaining consistent energy in successive blows of an impact device having a frame supporting at least one cylinder, a piston within said cylinder and means connecting said piston to a ram such that said ram is repeatedly movable relative to said frame from a retracted position into impact position, a driving fluid system, including a fluid supply and valve means from said fluid supply communicating through a port to said at least one cylinder at a position in the cylinder to drive said ram into impact position, comprising:

sensing when the piston and ram structure enters successive zones near the end of its return stroke;

timing the time the ram remains in a first of said successive zones to a first predetermined count assuring complete uncovering of the port in the cylinder by the piston on the return stroke; and opening said valve means if the first predetermined count is reached before a second of said successive zones is reached.

9. The method of claim 8 in which timing of the time the ram remains in the second zone to a second predetermined count is also accomplished if the valve is not opened in response to the count initiated in the first zone to open the valve means if the second predetermined count is reached before a third of said successive zones is reached.

10. The method of claim 9 in which timing of the time the ram remains in the third zone to a third predetermined count is also accomplished if the valve is not opened in response to the count initiated in the second zone to open the valve means when the third predetermined count is reached.

* * * * *

UNITED STATES PATENT OFFICE

CERTIFICATE OF CORRECTION

Patent No. 4,131,164 Dated December 26, 1978

Inventor(s) Wilmer W. Hague and Charles W. Frame

It is certified that error appears in the above-identified patent and that said Letters Patent are hereby corrected as shown below:

Column 1, line 18, "storke" should be --stroke--;
line 57, "storke" should be --stroke--;
line 64, "inpact" should be --impact--.

Column 2, line 62, "perferred" should be --preferred--.

Column 3, line 16, "modifiedand" should be --modified and--;
line 22, insert --under-- after "air" (first occurrence);
line 28, "the" (first occurrence) should be --and--;
line 33, "16a" should be --26a--.

Column 4, line 10, "thann the than" should be --than the programmed--.

Column 5, line 62, "systems" should be --system--.

Signed and Sealed this

Twenty-ninth Day of May 1979

[SEAL]

Attest:

RUTH C. MASON
Attesting Officer

DONALD W. BANNER
Commissioner of Patents and Trademarks